US009987647B2

(12) United States Patent
Drugeon et al.

(10) Patent No.: US 9,987,647 B2
(45) Date of Patent: Jun. 5, 2018

(54) DISPENSING HEAD FOR A COSMETIC PRODUCT, ASSOCIATED DEVICE AND METHOD

(71) Applicant: L'OREAL, Paris (FR)

(72) Inventors: Lionel Drugeon, La Garenne Colombes (FR); Jean-Marc Lebrand, Pantin (FR); Thierry Ramboz, Sannois (FR); Charles Boussiquet, Taverny (FR)

(73) Assignee: L'OREAL, Paris (FR)

( * ) Notice: Subject to any disclaimer, the term of this patent is extended or adjusted under 35 U.S.C. 154(b) by 0 days. days.

(21) Appl. No.: 15/105,334

(22) PCT Filed: Dec. 16, 2014

(86) PCT No.: PCT/EP2014/077964

§ 371 (c)(1),
(2) Date: Jun. 16, 2016

(87) PCT Pub. No.: WO2015/091483

PCT Pub. Date: Jun. 25, 2015

(65) Prior Publication Data

US 2016/0310976 A1 Oct. 27, 2016

(30) Foreign Application Priority Data

Dec. 18, 2013 (FR) ..... 13 62925

(51) Int. Cl.
*B05B 11/00* (2006.01)
*B65D 83/20* (2006.01)

(52) U.S. Cl.
CPC ..... *B05B 11/3057* (2013.01); *B05B 11/3047* (2013.01); *B05B 11/3056* (2013.01); *B65D 83/206* (2013.01); *B05B 11/3011* (2013.01)

(58) Field of Classification Search
CPC ..... B05B 11/3011; B05B 11/3047; B05B 11/3056; B05B 11/3057; B65D 83/206
See application file for complete search history.

(56) References Cited

U.S. PATENT DOCUMENTS 6,089,410 A * 7/2000 Ponton ..... B05B 11/0056 222/183
6,283,338 B1 * 9/2001 Geier ..... B65D 83/206 222/153.1

(Continued)

FOREIGN PATENT DOCUMENTS

DE 102012200545 A1 7/2013
EP 1118554 A1 7/2001

(Continued)

*Primary Examiner* — Paul R Durand
*Assistant Examiner* — Bob Zadeh
(74) *Attorney, Agent, or Firm* — Polsinelli PC

(57) ABSTRACT

Provided is a head having an actuating and product dispensing mechanism (30), which includes a coupling part, at least one product dispensing conduit (44), supported by the coupling part; a maneuvering lever (46), rotatably mounted on a pivot axis. A protective cap (32) is provided covering the actuating and dispensing mechanism (30), the protective cap (32) having the pivot axis situated outside the dispensing conduit (44), between the movement axis (A-A') and the dispensing opening (70).

21 Claims, 4 Drawing Sheets

(56) References Cited

U.S. PATENT DOCUMENTS

| | | | | |
|---|---|---|---|---|
| 2009/0289086 | A1* | 11/2009 | De Laforcade ..... | B05B 11/0027<br>222/402.13 |
| 2015/0014368 | A1* | 1/2015 | Greiner-Perth ..... | A61M 15/009<br>222/402.13 |
| 2016/0310976 | A1* | 10/2016 | Drugeon ..... | B05B 11/3056 |

FOREIGN PATENT DOCUMENTS

| | | | |
|---|---|---|---|
| EP | 1743706 | A1 | 1/2007 |
| FR | 2768409 | A1 | 3/1999 |
| FR | 2900645 | A1 | 11/2007 |
| WO | WO-01-44076 | A2 | 6/2001 |
| WO | WO-2013/065952 | A1 | 5/2013 |

* cited by examiner

DISPENSING HEAD FOR A COSMETIC PRODUCT, ASSOCIATED DEVICE AND METHOD

CROSS REFERENCE TO RELATED APPLICATIONS

This application is a National Phase filing under 35 U.S.C. § 371 of PCT/EP2014/077964 filed on Dec. 16, 2016; and this application claims priority to Application No. 1362925 filed in France on Dec. 18, 2013 under 35 U.S.C. § 119. The entire contents of each application are hereby incorporated by reference.

The present invention relates to a dispensing head for a cosmetic product comprising:

- an actuating and product dispensing mechanism comprising:
  - a coupling part for coupling to a product dispensing member mounted on a container,
  - at least one product dispensing conduit, supported by the coupling part, the dispensing conduit emerging by a dispensing opening for dispensing product outside the head;
- a handling lever, rotatably mounted around a pivot axis, the handling lever being able to move the coupling part along a movement axis between an idle position and a product dispensing position; the head comprising:
- a protective cap covering the actuating and product dispensing mechanism, the protective cap defining a product dispensing passage through which the dispensing conduit emerges, the protective cap comprising at least one part that is deformable to the touch, placed across from the handling lever.

This head is designed to be mounted at the end of a container containing a cosmetic product, to form a packaging and dispensing device for the cosmetic product that is particularly tight.

The cosmetic product is for example a fluid product, such as a liquid, gel, foam, cream or powder.

In particular, the cosmetic product is a sun protection product, designed to protect a surface of a user's body from exposure to solar radiation, in particular ultraviolet radiation (UVA or UVB).

More generally, a cosmetic product is a product as defined in EC Regulation no. 1223/2009 by the European Parliament and Council dated Nov. 30, 2009, relative to cosmetic products.

Some cosmetic products are used outside in dusty environments or environments involving macroscopic particles, such as grains of sand, or in a wet environment, in particular due to spraying or immersion. This is in particular the case for sunscreens, which are for example used on the beach or in nature.

In that case, the device for packaging and dispensing the cosmetic product must be suitable for its use, and for the contamination that may occur due to particles and/or dust, as well as moisture.

In order to protect the container containing the product and the actuating pump for dispensing the product, it is known to mount a dispensing head of the aforementioned type on the container. The head comprises a protective cap, which at least partially conceals the dispensing mechanism and the pump, which participates in protecting the packaging from outside contamination.

Using a protective cap nevertheless creates difficulties during handling of the device in order to dispense the product. In particular, the actuation of the pump may be tedious, and requires significant actuating force.

To offset this problem, it is for example known from WO 2013/10741 to use a cap comprising a rigid support part and a flexible handling part that is deformable to the touch. U.S. Pat. No. 6,905,049 also describes a container having a cap provided with a part that is deformable to the touch.

In order to dispense the product, the user presses on the flexible part and thus moves a coupling part with the pump. This causes cosmetic product to be dispensed outside the container.

One aim of the invention is to obtain a cosmetic product dispensing head that allows the product to be dispensed, without causing a high actuating force, while guaranteeing tightness of the packaging device, advantageously meeting standard CEI 60529.

To that end, the invention relates to a head of the aforementioned type, characterized in that the pivot axis is located outside the dispensing conduit, between the movement axis and the dispensing opening.

The head according to the invention may include one or more of the following features, considered alone or according to any technically possible combination(s):

- the dispensing opening is stationary at least along the movement axis during movement of the coupling part between the idle position and the product dispensing position;
- the dispensing opening is stationary along an axis perpendicular to the movement axis during the movement of the coupling part between the idle position and the product dispensing position;
- the dispensing conduit is deformable by bending during movement of the coupling part between the idle position and a product dispensing position;
- the protective cap defines a lower bearing region on the container and/or on the actuating and dispensing mechanism, the head comprising a sealing zone positioned between the lower bearing region on the one hand and the container and/or the actuating and dispensing mechanism on the other hand;
- the sealing zone is axially, laterally or radially interposed between the lower bearing region on the one hand, and the container and/or the actuating and dispensing mechanism on the other hand;
- the sealing zone is defined by a sealing member positioned between the lower bearing region on the one hand, and the container and/or the actuating and dispensing mechanism on the other hand, the sealing member advantageously being attached between the lower bearing region on the one hand, and the container and/or the actuating and dispensing mechanism on the other hand, or integral with the deformable part of the cap;
- the actuating and dispensing mechanism comprises a stationary insert comprising a base for mounting on one end of a container;
- the insert comprises a support tab for the lever, extending around the dispensing opening, the maneuvering lever being articulated on the support tab around the pivot axis, in particular by a hinge link;
- the maneuvering lever comprises:
  - an articulation arm on the actuating and dispensing mechanism, situated between the dispensing opening and the movement axis,
  - a movement region on the coupling part, situated in the movement axis, and a maneuvering plate, situated opposite the dispensing opening relative to the movement axis, the maneuvering plate being able to be pushed manually by the user, the deformable part of the protective cap advantageously comprising a maneuvering region for the maneuvering plate, positioned across from the maneuvering plate, advantageously applied on the maneuvering plate;

the maneuvering lever is placed bearing on the coupling part without being connected to the coupling part at the bearing;

the protective cap comprises a front region covering the dispensing opening, the front region comprising a passage slot for the product or a product dispensing nozzle;

it includes a plurality of separate dispensing conduits.

The invention also relates to a device for packaging and dispensing a cosmetic product, comprising:

a container defining a reservoir designed to contain the cosmetic product;

a product dispensing member, advantageously a pump, mounted on the container;

a head as described above, capping the container and the dispensing member, the coupling part being engaged on the dispensing member.

The device according to the invention may include one or more of the following features, considered alone or according to any technically possible combination(s):

the protective cap defines a lower bearing region on the container, the head comprising a tight zone positioned between the lower bearing region and the container.

The invention also relates to a method for dispensing a product on a bodily surface comprising the following steps:

providing a device as defined above;

manually deforming the deformable part of the protective cap to maneuver the maneuvering lever;

moving the coupling part by rotating the maneuvering lever around a pivot axis between the idle position and the dispensing position;

activating the dispensing member using the coupling part;

dispensing product through the dispensing member, the dispensing conduit, and the dispensing opening.

The invention will be better understood upon reading the following description, provided solely as an example and done in reference to the appended drawings, in which.

Figure 2:
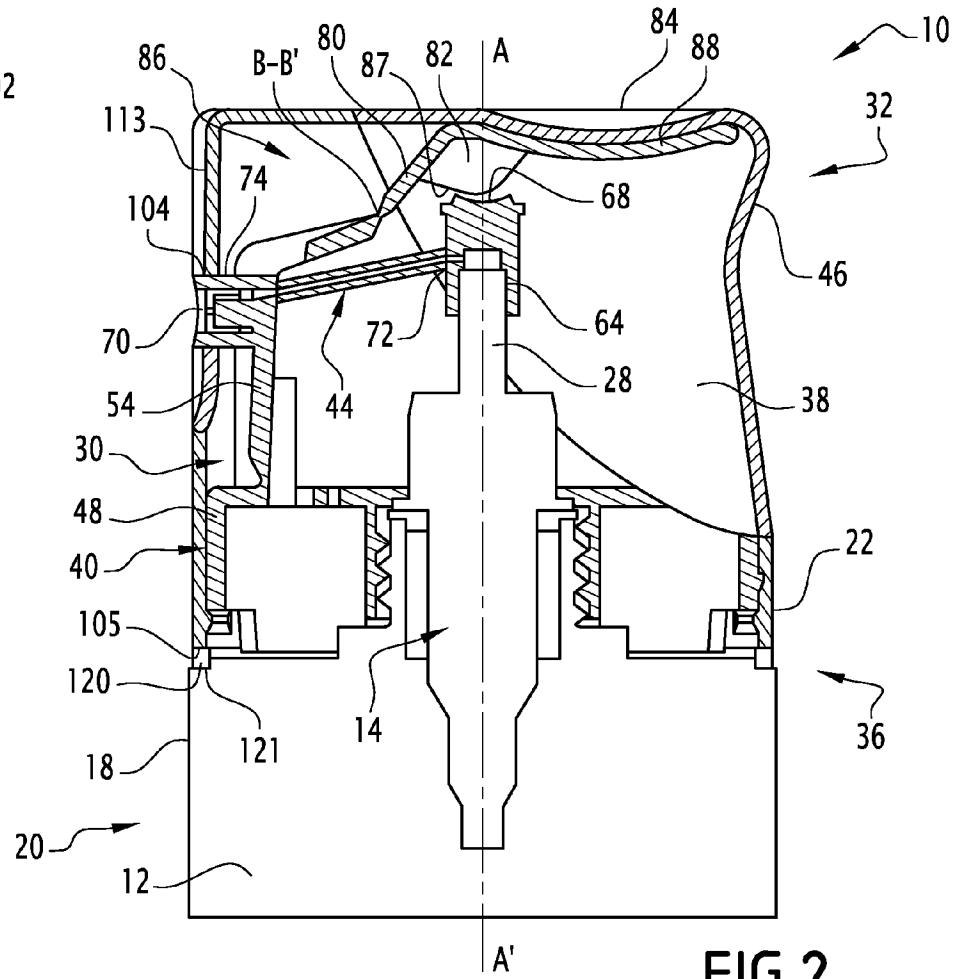
FIG. 2 is a cross-section along a median axial plane of the device of FIG. 1.
Figure 1:
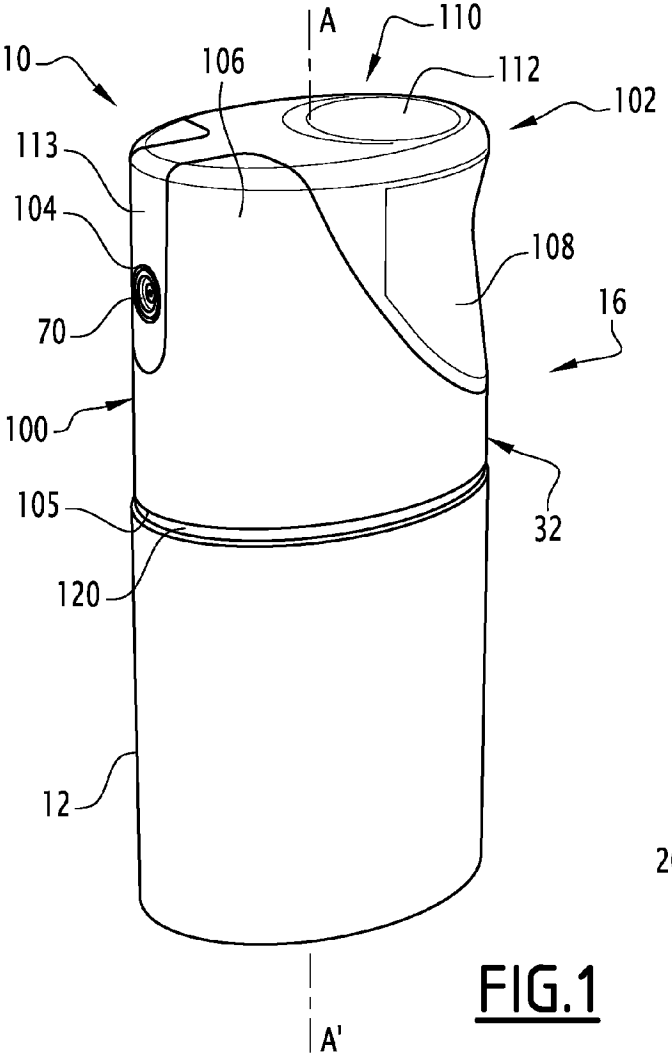
FIG. 1 is a side view of a first packaging and dispensing device, provided with a dispensing head according to the invention.

In the rest of the document, the terms "inner" and "outer" are to be understood relative to the contents of the container. The term "inner" is generally understood as closer to the contents of the container, while the term "outer" is generally understood as further from the contents of the container.

A first device 10 for packaging and dispensing a cosmetic product according to the invention is illustrated by FIGS. 1 to 4.

The cosmetic product packaged and dispensed by the device 10 is for example a fluid product, such as a liquid, gel, foam, cream or powder.

In particular, the cosmetic product is a sun protection product, designed to protect a surface of a user's body from exposure to solar radiation, in particular ultraviolet radiation (UVA or UVB).

The device 10 comprises a container 12 containing the cosmetic product, a product dispensing member 14 (shown in FIG. 2), mounted on one end of the container 12, and a dispensing head 16 according to the invention, capping the container 12 and the product dispensing member 14.

The container 12 comprises a hollow wall 18, delimiting a reservoir 20 containing cosmetic product, and a neck 22 through which the reservoir 20 emerges.

The dispensing member 14 here is made up of a pump.

The dispensing member 14 comprises a moving actuating element 28 movable along an axis A-A' to cause the product to be dispensed.

The dispensing head 16 comprises an actuating and dispensing mechanism 30 for the product, and a protective cap 32 covering the actuating and dispensing mechanism 30, and the dispensing member 14.

The dispensing head 16 advantageously includes a sealing assembly 36, preventing contamination of the inner volume 38 defined by the protective cap 32.

Figure 4:
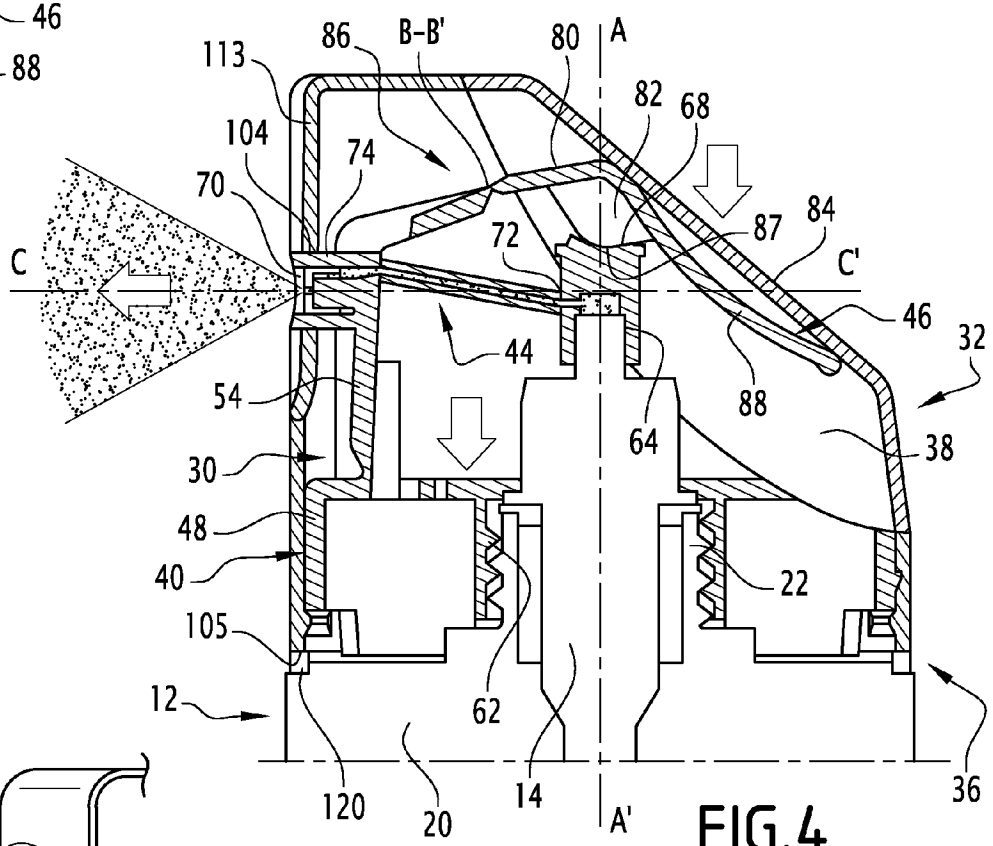
FIG. 4 is a view similar to FIG. 2, during actuation of the head.
Figure 3:
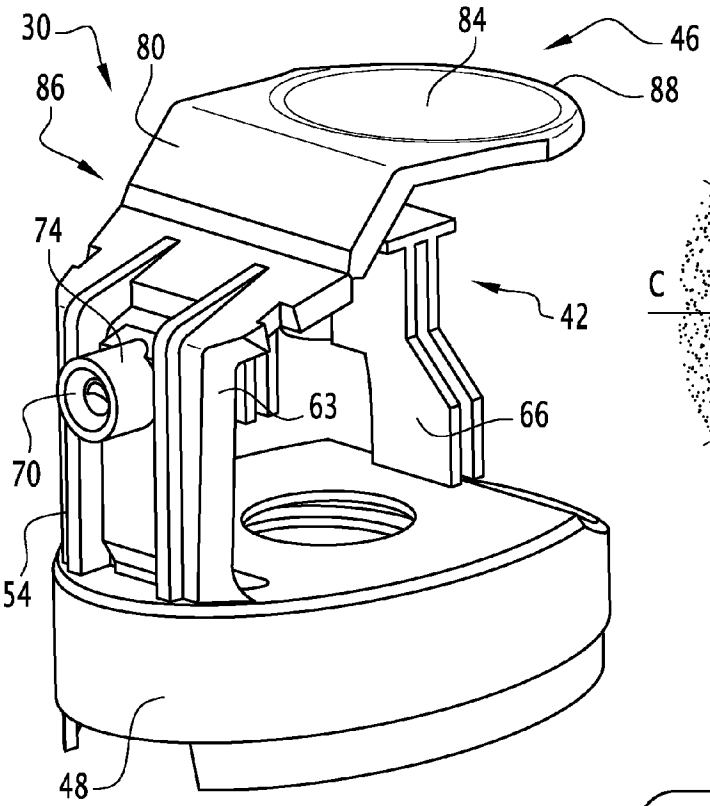
FIG. 3 is a three-quarters perspective front view of the actuating and dispensing mechanism of FIG. 1.

As illustrated by FIGS. 3 and 4, the actuating and dispensing mechanism 30 comprises an insert 40 engaged on the container 12 around the neck 22 and the dispensing member 14, a movable part 42 for coupling with the dispensing member 14, and a conduit 44 for dispensing product toward the outside of the device 10.

The actuating and dispensing mechanism 30 further comprises a rotary lever 46, articulated on the insert 40 around a pivot axis B-B' that is advantageously transverse to the movement axis A-A'.

As illustrated by FIG. 4, the insert 40 comprises a base 48 for mounting on the container 12.

The insert 40 further comprises a tab 54 for supporting the lever 46, protruding relative to the base 48.

The base 48 here has a cross-section similar to that of the hollow wall 18 of the container 12. It is advantageously of revolution around the axis A-A'.

The base 48 defines a continuous central aperture 62, with axis A-A', emerging axially inward and downward in FIG. 2, and outward and upward in FIG. 2.

The central aperture 62 receives the dispensing member 14.

The tab 54 protrudes outward from the base 48 of the insert 40. It advantageously extends parallel to the movement axis A-A', from the periphery of the base 48.

In this example, it has an upper rim 63 for supporting the lever 46, which protrudes transversely to the axis A-A'.

As illustrated by FIGS. 2 and 4, the coupling part 42 comprises a hollow lid 64 for engaging on the moving element 28.

A coupling part 42 advantageously comprises guide wings 66 (shown in FIG. 3) protruding transversely relative to the lid 64. The wings 66 cooperate with the inner raised portions in the cap 32 to guide the translation of the lid 64 along the axis A-A'.

The lid 64 emerges axially inward. The free end of the moving element 28 is inserted into the lid 64.

The coupling part 42 has an upper contact surface 68 with the lever 46, advantageously situated on the lid 64.

The coupling part 42 is translatable along the axis A-A', jointly with the moving element 28, between an upper idle position, in which the cosmetic product is conveyed in the reservoir 20, and a lower dispensing position, in which cosmetic product flows from the reservoir 20, through the moving element 28, the hollow lid 64, and the dispensing conduit 44.

The travel of the coupling part 42 and the moving element 28 along the axis A-A' is for example greater than 6 mm and is in particular comprised between 2 mm and 8 mm.

This considerable travel allows a significant volume of product to be dispensed, for example greater than 2 mm, by a single actuation of the moving element 28.

The dispensing conduit 44 protrudes transversely relative to the lid 64.

It emerges downstream outside the device 10 and the head 16 by a product dispensing opening 70.

In this example, the dispensing opening 70 is stationary, in particular along the axis A-A', during a movement of the coupling part 42 between the idle position and a product dispensing position.

The dispensing conduit 44 comprises an upstream end 72 secured to the moving part 42 and a downstream end 74 fastened on the insert 40, the downstream end 74 defining the dispensing opening 70.

The dispensing conduit 44 emerges at the upstream end 72 in the moving part 42, advantageously at the hollow lid 64.

At the downstream end 74, it comprises a dispensing nozzle inserted through the tab 54, near the outer end of the tab 54. The dispensing nozzle has a cross-section larger than that of the upstream part of the dispensing conduit 44.

The downstream end 74 of the dispensing conduit 44 remains stationary with the dispensing opening 70, during movement of the upstream end 72 jointly with the moving part 42.

The dispensing conduit 44 is deformable by bending during movement of the moving part 42 between the idle position and a product dispensing position.

In this example, the insert 40, the moving part 42 and the dispensing conduit 44 are made in a single piece and integrally.

The lever 46 comprises an articulation arm 80, rotatably mounted on the insert 40 around the axis B-B', a bearing region 82 on the coupling part 42, and a maneuvering plate 84, designed to be pushed by one of the user's fingers pressing on the protective cap 32.

The articulation arm 80 is positioned between the dispensing opening 70 and the pivot axis A-A', above the dispensing conduit 44.

It is articulated around a pivot axis B-B', at the upper end of the tab 54, advantageously by means of an articulation assembly 86 including a flexible hinge.

According to the invention, the pivot axis B-B' is situated between the dispensing opening 70 and the movement axis A-A'. The pivot axis B-B' is also situated outside the dispensing conduit 44 relative to the container 12, above the dispensing conduit 44 in FIG. 2.

The positioning of the pivot axis B-B' optimizes the movement of the coupling part 42 and the moving element 28, for a given force applied to the opposite end of the lever 46.

The bearing region 82 is rotatable around a pivot axis B-B' jointly with the arm 80. It comprises an inner bearing surface 87 on the outer surface 68 of the moving part 42, situated in the movement axis A-A', or in the vicinity thereof.

The maneuvering plate 84 is situated opposite the dispensing opening 70 relative to the axis A-A'. It advantageously defines a basin 88 for receiving a user's finger, with the concave side oriented outward.

The maneuvering plate 84 can be pushed by a user through the protective cap 32 toward the container 12, to rotate the bearing region 82 around the axis B-B', and push the coupling part 42 from its idle position to its dispensing position.

The protective cap 32 comprises a lateral peripheral wall 100 surrounding the actuating and dispensing mechanism 30 and the dispensing member 14, around an axis A-A'. It comprises an upper wall 102 outwardly closing off the lateral peripheral wall 100, transversely relative to the movement axis A-A'.

The walls 100, 102 are preferably solid, with the exception of a transverse passage 104, extending around the dispensing opening 70. The cap 32 thus tightly defines the inner volume 38, providing protection of that volume 38 against outside contamination.

The lateral peripheral wall 100 defines a closed free inner edge 105, extending across from a shoulder of the container 12.

According to the invention, the cap 32 comprises a rigid support part 106, and a flexible actuating part 108 that is deformable to the touch.

The rigid support part 106 extends on either side of the passage 104, in front of the head 14 and laterally as far as the rear of the head 14.

It is made from a material that is substantially not deformable to the touch, such as polypropylene, polyethylene, polyamide, polyethylene terephthalate, polystyrene, or copolymers or mixtures thereof.

The rigid part 106 defines a rear notch, on which the flexible part 108 is positioned.

The flexible part 108 extends in the continuation of the rigid support part 106, flush with the rigid support part 106. It is made from a material that is deformable to the touch, such as an elastomer of the polystyrene-b-poly(ethylene-butylene)-b-polystyrene (SEBS) type, rubber, thermoplastic elastomer (TPE), etc.

To ensure continuity between the flexible part 108 and the rigid part 106, the protective cap 32 is preferably made using a bi-injection method for a material designed to be substantially not deformable to the touch and a material designed to be deformable to the touch.

The flexible part 108 comprises a deformable upper region 110 for maneuvering the lever 46, and deformable lateral regions 112, and a region 113 positioned around the dispensing opening 70 defining the passageway 104.

The maneuvering region 110 advantageously extends transversely relative to the axis A-A'. It is pressed on the maneuvering plate 84. It advantageously defines an outer basin 112 for guiding a user's fingers.

The upper region 110 can be manually deformed toward the inside of the container 12 to be able to pivot the lever 46 and actuate the moving element 28, by moving the moving part 42 between its idle position and its actuating position.

In light of the lever effect, the force applied on the upper region 110 to create a sufficient travel of the moving element 28 along the axis A-A' remains controlled, which facilitates the use of the device 10.

This force is for example less than 20 N, more generally between 5 N and 30 N. The tight assembly 36 advantageously comprises a tight zone 120 positioned between a lower region 105 of the cap 32 and the container 12, to tightly close off the inner volume 38 of the free edge 105.

In the example illustrated by FIG. 2, the sealing zone 120 extends axially, vertically in FIG. 2, between the free lower edge of the cap 32 and a shoulder 121 defined on the container 12.

In this example, the sealing zone 120 is formed by a sealing member attached between the lower region 105 of the cap 32 and the shoulder 121 on the container 12.

The sealing member is for example an O-ring made from elastomer.

Figure 6:
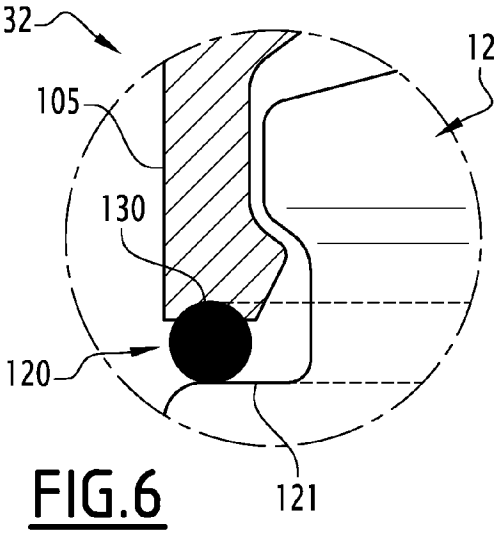

In one alternative, shown in FIG. 6, the lower edge of the cap 32 defines an annular slot 130 emerging axially toward the shoulder 121 on the container 12. The slot 130 receives the sealing member, which protrudes axially toward the shoulder 121 starting from the slot 130.

Figure 7:
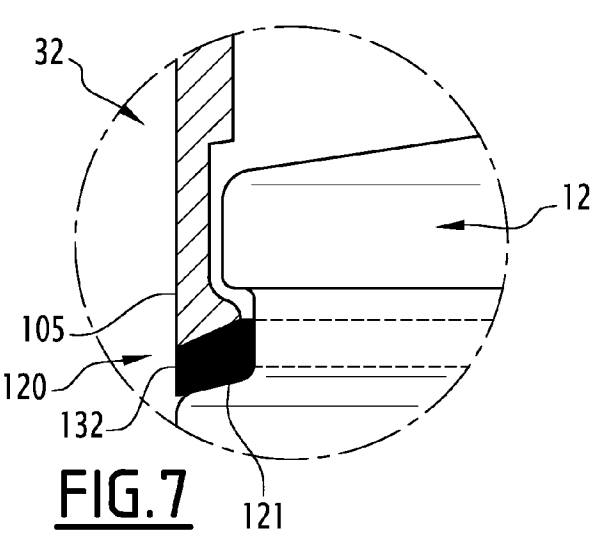
FIGS. 6 to 8 illustrate alternative embodiments of the axial space between the cap and the container containing a product.
Figure 8:
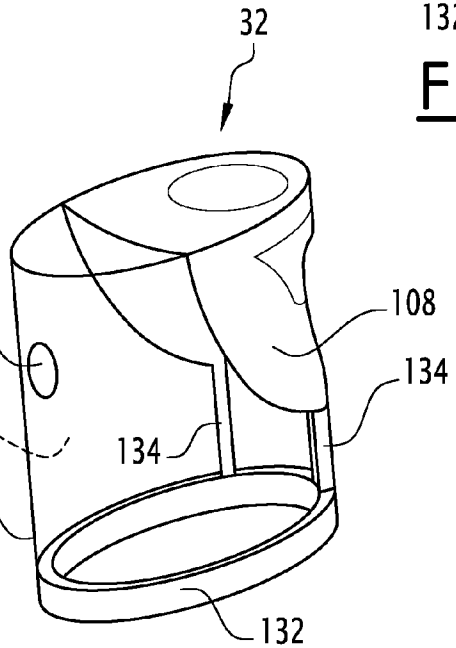

In another alternative, shown in FIGS. 7 and 8, the sealing member is secured to the cap 32. It is formed by an annular ring 132 integral with the flexible part 108 of the cap 32. The annular ring 132 is positioned on the free lower edge of the rigid part 106 of the cap 32.

The annular ring 132 is advantageously connected to the lower edge of the flexible part 108 by axial lines 134 of flexible material.

The annular ring 132 is therefore very easy to manufacture, during overmolding of the flexible part 108 of the cap 32.

Figure 9:
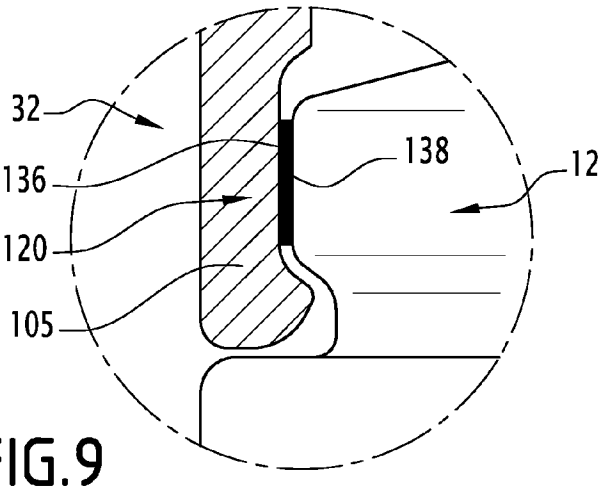
FIGS. 9 to 12 illustrate alternative embodiments of radial tightness between the cap and the container containing the product.

In another alternative, shown in FIG. 9, the sealing zone 120 is made by gripping, advantageously radial gripping, between an inner peripheral surface 136 of the cap 32 and an outer peripheral surface 138 of the container 12.

Figure 10:
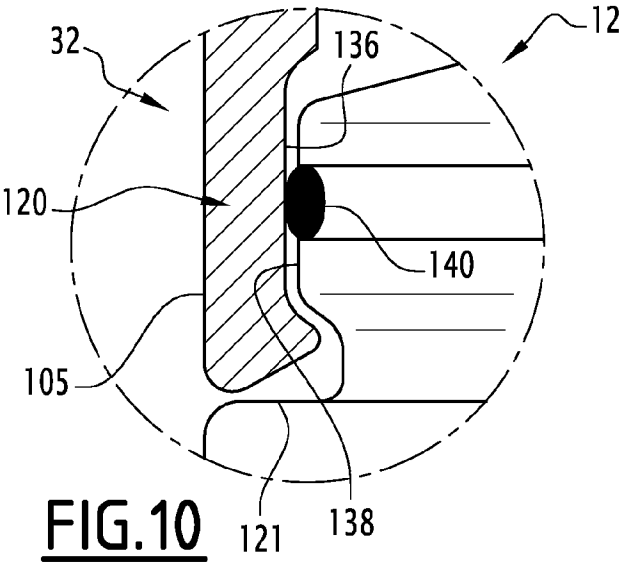

In an alternative of FIG. 9, illustrated in FIG. 10, a peripheral housing 140 is arranged in the outer peripheral surface 138 and/or in the inner peripheral surface 136. A sealing member is radially attached in the housing 140 between the surfaces 136, 138 to form a sealing zone 120.

Figure 11:
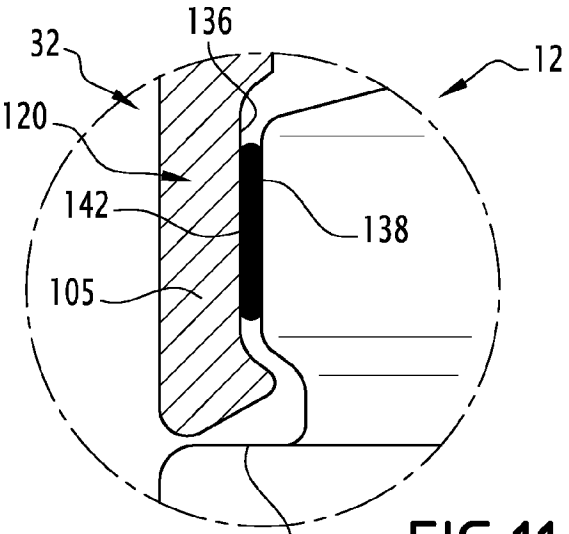
Figure 12:
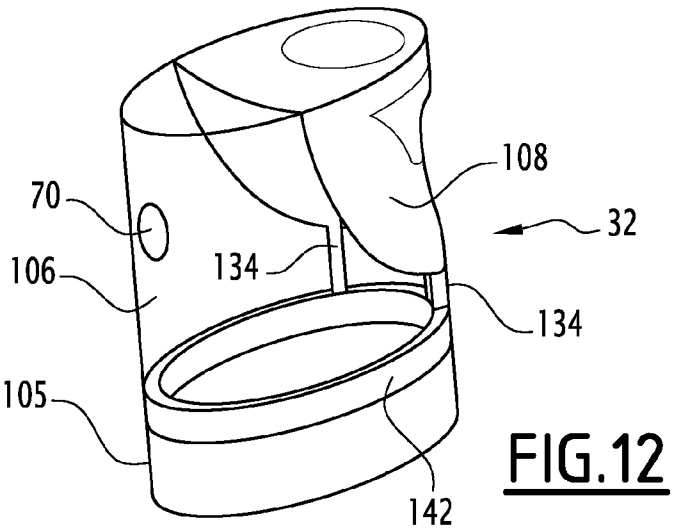

In the alternative of FIGS. 11 and 12, as in the embodiment of FIGS. 7 and 8, the sealing member is secured to the cap 32. It is formed by an annular strip 142 integral with the flexible part 108 of the cap 32. The annular strip 142 protrudes radially on the inner peripheral surface 136 of the rigid part 106 of the cap 32, above the lower free edge of the cap 32, toward the outer peripheral surface 138. It comes into contact with that surface 138.

The annular strip 142 is advantageously connected to the lower edge of the flexible part 108 by axial lines 134 of flexible material.

The operation of the device 10 according to the invention will now be described.

Initially, when the device 10 is not used, the protective cap 32 is idle. The coupling part 42 is in its upper position, keeping the lever 46 in an upper configuration separated from the container 12.

The protective cap 32 tightly covers the dispensing member 14, and the actuating mechanism 30 with the exception of the passageway 104 allowing access to the dispensing opening 70.

The presence of the sealing zone 120 completes the tightness provided by the cap 32 around the container 12.

The risk of contamination, in particular by particles and dust, is therefore greatly limited, advantageously allowing the device 10 to meet standard CEI 60529.

A user wishing to apply a cosmetic product on a bodily surface grasps the dispensing head 16.

The user then presses on the upper region 110 for maneuvering the flexible part 108, pushing that upper region 110 toward the container 12 while manually deforming the flexible part 108.

The pressure exerted on the upper maneuvering region 110 is transmitted to the maneuvering plate 84, driving the rotation of the lever 46 around the axis B-B'.

The rotation of the lever 46 toward the container 12 causes the region 82 to bear on the upper surface 68 of the coupling part 42. This causes a translational movement along the axis A-A' by the coupling part 42 and the moving element 28, and dispensing of the cosmetic product, as shown in FIG. 4.

The cosmetic product is conveyed through the moving element 28, in the lid 64, and in the dispensing conduit 44 as far as the opening 70, where it leaves the dispensing head 16, to reach the bodily surface.

The user then releases the flexible part 108, which returns to its idle configuration, advantageously under the effect of the return of the moving element 28, driving the coupling part 42 and the lever 46 away from the container 12.

As seen above, the force the user must apply remains low and controlled, for a movement of the moving element 28 causing a substantial volume of cosmetic product to be dispensed outside the container 12.

Figure 5:
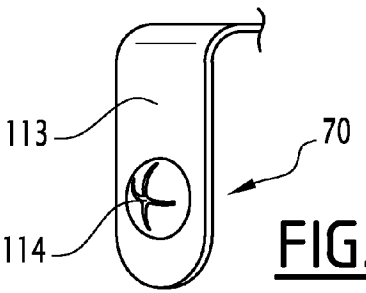
FIG. 5 is a detailed view of a cap covering an alternative head according to the invention.

In the alternative shown in FIG. 5, the front region 113 of the cap 32 covers the dispensing opening 70. A slot 114 is arranged in the front region 113 to allow the passage of product.

In another alternative, the dispensing conduit 44 has no nozzle.

In still another alternative, the dispensing opening 70 remains stationary along the axis A-A' during the movement of the coupling part 42, but translates toward the outside along a transverse axis C-C' shown in FIG. 4. A valve/gate function is then possible, to improve the tightness.

In another alternative, the mechanism 30 comprises several separate dispensing conduits 44, which may or may not be parallel or implemented differently.

The invention claimed is:

1. A dispensing head for a cosmetic product comprising:

an actuating and product dispensing mechanism comprising:

a coupling part for coupling to a product dispensing member mounted on a container, at least one product dispensing conduit, supported by the coupling part, the dispensing conduit emerging by a dispensing opening for dispensing product outside the head;

a handling lever, rotatably mounted around a pivot axis (B-B'), the handling lever being able to move the coupling part along a movement axis (A-A') between an idle position and a product dispensing position;

a protective cap covering the actuating and product dispensing mechanism, the protective cap defining a product dispensing passage through which the dispensing conduit emerges, the protective cap comprising at least one part that is deformable to the touch, placed across from the handling lever;

wherein the pivot axis (B-B') is located outside the dispensing conduit, between the movement axis (A-A') and the dispensing opening, wherein the actuating and dispensing mechanism comprises a stationary insert comprising a base for mounting on one end of the container and wherein the insert comprises a support tab for the lever, extending around the dispensing opening, the handling lever being articulated on the support tab around the pivot axis (B-B').

2. The head according to claim 1, wherein the dispensing opening is stationary at least along the movement axis (A-A') during movement of the coupling part between the idle position and the product dispensing position.

3. The head according to claim 2, wherein the dispensing opening is stationary along an axis perpendicular to the movement axis (A-A') during the movement of the coupling part between the idle position and the product dispensing position.

4. The head according to claim 2, wherein the dispensing conduit is deformable by bending during movement of the coupling part between the idle position and the product dispensing position.

5. The head according to claim 2, wherein the protective cap defines a lower bearing region on the container and/or on the actuating and product dispensing mechanism, the head comprising a sealing zone positioned between the lower bearing region on the one hand and the container and/or the actuating and product dispensing mechanism on the other hand.

6. The head according to claim 3, wherein the dispensing conduit is deformable by bending during movement of the coupling part between the idle position and the product dispensing position.

7. The head according to claim 3, wherein the protective cap defines a lower bearing region on the container and/or on the actuating and product dispensing mechanism, the head comprising a sealing zone positioned between the lower bearing region on the one hand and the container and/or the actuating and product dispensing mechanism on the other hand.

8. The head according to claim 1, wherein the dispensing conduit is deformable by bending during movement of the coupling part between the idle position and the product dispensing position.

9. The head according to claim 8, wherein the protective cap defines a lower bearing region on the container and/or on the actuating and product dispensing mechanism, the head comprising a sealing zone positioned between the lower bearing region on the one hand and the container and/or the actuating and product dispensing mechanism on the other hand.

10. The head according to claim 1, wherein the protective cap defines a lower bearing region on the container and/or on the actuating and product dispensing mechanism, the head comprising a sealing zone positioned between the lower bearing region on the one hand and the container and/or the actuating and product dispensing mechanism on the other hand.

11. The head according to claim 10, wherein the sealing zone is axially, laterally or radially interposed between the lower bearing region on the one hand, and the container and/or the actuating and product dispensing mechanism on the other hand.

12. The head according to claim 10, wherein the sealing zone is defined by a sealing member positioned between the lower bearing region on the one hand, and the container and/or the actuating and product dispensing mechanism on the other hand, the tight sealing member.

13. The head according to claim 12, wherein the sealing member is attached between the lower bearing region on the one hand, and the container and/or the actuating and dispensing mechanism on the other hand, or integral with the deformable part of the cap.

14. The head according to claim 1, wherein the handling lever is placed bearing on the coupling part without being connected to the coupling part at the bearing.

15. The head according to claim 1, wherein the protective cap comprises a front region covering the dispensing opening, the front region comprising a passage slot for the product or a product dispensing nozzle.

16. The head according to claim 1, comprising a plurality of separate dispensing conduits.

17. A device for packaging and dispensing comprising:

the head according to claim 1, capping the container and the dispensing member, the coupling part being engaged on the dispensing member.

18. The device according to claim 17, wherein the protective cap defines a lower bearing region on the container, the head comprising a sealing zone positioned between the lower bearing region and the container.

19. The head according to claim 17, wherein the product dispensing member is a pump.

20. The head according to claim 1, wherein the handling lever is articulated on the support tab around the pivot axis by a hinge link.

21. A dispensing head for a cosmetic product comprising:

an actuating and product dispensing mechanism comprising:

a coupling part for coupling to a product dispensing member mounted on a container, at least one product dispensing conduit, supported by the coupling part, the dispensing conduit emerging by a dispensing opening for dispensing product outside the head;

a handling lever, rotatably mounted around a pivot axis (B-B'), the handling lever being able to move the coupling part along a movement axis (A-A') between an idle position and a product dispensing position;

a protective cap covering the actuating and product dispensing mechanism, the protective cap defining a product dispensing passage through which the dispensing conduit emerges, the protective cap comprising at least one part that is deformable to the touch, placed across from the handling lever;

wherein the pivot axis (B-B') is located outside the dispensing conduit, between the movement axis (A-A') and the dispensing opening, wherein the actuating and dispensing mechanism comprises:

an articulation arm on the actuating and dispensing mechanism, situated between the dispensing opening and the movement axis (A-A'), a movement region on the coupling part, situated in the movement axis (A-A'), and a maneuvering plate, situated opposite the dispensing opening relative to the movement axis (A-A'), the maneuvering plate being able to be pushed manually by a user, the deformable part of the protective cap advantageously comprising a maneuvering region or the maneuvering plate, positioned across from the maneuvering plate, advantageously applied on the maneuvering plate.

* * * * *